US009453685B2

(12) United States Patent
Miao et al.

(10) Patent No.: US 9,453,685 B2
(45) Date of Patent: Sep. 27, 2016

(54) PLATE-FIN TYPE HEAT EXCHANGER WITHOUT SEALING STRIP

(75) Inventors: Zhixian Miao, Beijing (CN); Xiang Ling, Jiangsu (CN); Faqing Niu, Jiangsu (CN)

(73) Assignee: WUXI HONGSHENG HEAT EXCHANGER CO., LTD. (CN)

( * ) Notice: Subject to any disclaimer, the term of this patent is extended or adjusted under 35 U.S.C. 154(b) by 532 days.

(21) Appl. No.: 12/602,502

(22) PCT Filed: Jan. 2, 2008

(86) PCT No.: PCT/CN2008/000011

§ 371 (c)(1),
(2), (4) Date: Dec. 1, 2009

(87) PCT Pub. No.: WO2008/151497

PCT Pub. Date: Dec. 18, 2008

(65) Prior Publication Data

US 2010/0175858 A1 Jul. 15, 2010

(30) Foreign Application Priority Data

Jun. 12, 2007 (CN) ..... 2007 1 0023651

(51) Int. Cl.

| | |
|---|---|
| ***F28F 3/08*** | (2006.01) |
| ***F28F 3/00*** | (2006.01) |
| ***F28D 7/02*** | (2006.01) |
| ***F28D 9/00*** | (2006.01) |
| ***F28F 3/02*** | (2006.01) |

(52) U.S. Cl.

CPC ..... *F28D 9/005* (2013.01); *F28F 3/027* (2013.01); *F28F 2215/04* (2013.01)

(58) Field of Classification Search

CPC ..... F28D 9/005; F28D 9/0043; F28F 3/027; F28F 2215/04

USPC ..... 165/164–167

See application file for complete search history.

(56) References Cited

U.S. PATENT DOCUMENTS

| | | | | |
|---|---|---|---|---|
| 3,179,165 | A * | 4/1965 | Usher et al. | 165/167 |
| 3,380,517 | A * | 4/1968 | Butt | 165/166 |
| 3,568,462 | A * | 3/1971 | Hoffman et al. | 202/158 |
| 3,612,494 | A * | 10/1971 | Toyama et al. | 261/102 |
| 3,860,065 | A * | 1/1975 | Schauls | 165/166 |
| 3,992,168 | A * | 11/1976 | Toyama et al. | 165/166 |
| 4,282,927 | A * | 8/1981 | Simmons | 165/166 |
| 4,347,896 | A * | 9/1982 | Rosman et al. | 165/166 |
| 4,781,248 | A * | 11/1988 | Pfeiffer | 165/167 |
| 5,031,693 | A * | 7/1991 | VanDyke | 165/166 |
| 5,226,474 | A * | 7/1993 | Hallgren | B01D 1/221 165/110 |
| 5,316,628 | A * | 5/1994 | Collin et al. | 203/72 |

(Continued)

FOREIGN PATENT DOCUMENTS

| | | |
|---|---|---|
| CN | 1844827 | 10/2006 |
| CN | 101071051 | 11/2007 |
| JP | 60180632 | 9/1985 |

*Primary Examiner* — Frantz Jules
*Assistant Examiner* — Claire Rojohn, III
(74) *Attorney, Agent, or Firm* — Schmeiser, Olsen & Watts, LLP

(57) ABSTRACT

A plate-fin type heat exchanger without sealing strip, includes outer shield plates (2), nozzles (3), several heat exchanging plates (1) with fins (9) and peripheral sealing inclined plane (5). Among the heat exchanging plates (1), the heat exchanging fins (9) in at least one heat exchanging medium flow layer are transversely provided.

7 Claims, 3 Drawing Sheets

(56) References Cited

U.S. PATENT DOCUMENTS

| | | | | |
|---|---|---|---|---|
| 5,625,229 | A * | 4/1997 | Kojima et al. | 257/712 |
| RE35,890 | E * | 9/1998 | So | 165/109.1 |
| 6,039,112 | A | 3/2000 | Ruppel et al. | |
| 6,244,334 | B1 | 6/2001 | Wu et al. | |
| 2002/0011331 | A1* | 1/2002 | Lehman | F25J 5/002 165/166 |
| 2003/0188855 | A1* | 10/2003 | Maeda et al. | 165/166 |
| 2003/0201094 | A1* | 10/2003 | Evans et al. | 165/109.1 |
| 2004/0168793 | A1* | 9/2004 | Blomgren | 165/167 |
| 2004/0177668 | A1 | 9/2004 | Sagasser et al. | |
| 2005/0082049 | A1* | 4/2005 | Brost | 165/166 |
| 2005/0161494 | A1 | 7/2005 | Matsu | |
| 2005/0168793 | A1* | 8/2005 | Aizawa et al. | 359/254 |
| 2006/0032621 | A1* | 2/2006 | Martin et al. | 165/167 |
| 2006/0048921 | A1* | 3/2006 | Usui et al. | 165/109.1 |
| 2008/0210414 | A1* | 9/2008 | Blomgren | F28D 9/005 165/166 |
| 2009/0008071 | A1 | 1/2009 | Miao et al. | |

* cited by examiner

PLATE-FIN TYPE HEAT EXCHANGER WITHOUT SEALING STRIP

TECHNICAL FIELD

This invention relates to a type of heat exchanger, in particular a type of plate-fin heat exchanger without seal strip.

BACKGROUND OF THE INVENTION

In traditional plate-fin heat exchanger without seal strip, fins are placed in heat exchange plates with fin pitch cross section facing heat transfer medium, resulting in a parallel arrangement mode of fins. In this way, heat transfer medium can smoothly flow past fins to transfer heat. For example, patents No. 200610039927.1 and No. 02828683.9 adopt this mode of fins arrangement as described in their figures.

In traditional plate-fin heat exchanger without seal strip, this parallel arrangement mode of fins has relatively low heat exchange efficiency. To satisfy heat exchange requirements on medium fluid, the method of additional heat exchange plates and fins is normally adopted, resulting in relatively large volume and heavy weight of the product, and relatively high costs.

In traditional plate-fin heat exchanger without seal strip, this parallel arrangement mode of fins normally cannot satisfy heat exchange requirements on some media, in particular media subject to change of phase during heat exchange such as cooling media. This limits application of this type of heat exchange in traditional plate-fin heat exchanger without seal strip.

SUMMARY OF THE INVENTION

The purpose of this invention is to solve aforesaid problems in existing technology and provide a type of plate-fin heat exchange without seal strip of high heat exchange efficiency, relatively small volume and light weight, and low cost, that can satisfy heat exchange using media subject to change of phase.

Technical scheme to realize purposes of this invention: A type of plate-fin heat exchanger without seal strip, including external retainers, pipe nozzles, and a number of heat exchange plates with fins, and peripheral sealing cant, wherein in said number of heat exchange plates with fins, transverse arrangement of heat exchange fins is adopted on at least one heat exchange medium flowing plane.

Said transverse arrangement of heat exchange fins on heat exchange plates refers to that fin fluctuating and extending direction is parallel to overall flowing direction of heat exchange medium in heat exchanger.

In this invention, by changing fin direction, i.e. rotating traditional fin arrangement direction plane by 90°, fin pitch cross section is parallel to overall flowing direction of heat exchange medium in heat exchanger, resulting in a transverse arrangement mode of fins. Inside heat exchange fins, heat exchange medium is blocked and disturbed by fin bulging parts, so that the medium is forced to flow transversely in short distance passing notches or small holes on fins and the medium has the trend of flowing in continuous S shape in transverse fins in each heat exchange plane, with the aim to increase heat exchange efficiency of various media between fin and plate subject to permitted media flowing resistance, thereby reducing quantity of heat exchange plates and fins, and product volume, weight, and cost, and satisfying heat exchange requirements on media of phase change nature.

Plate-fin heat exchanger without seal strip that adopts the technical scheme of this invention can be used mainly for evaporator, condenser, and other heat exchange environments, in particular heat exchange of various cooling media of 2-phase nature used in the refrigerating industry.

In traditional plate-fin heat exchanger without seal strip, there are many forms of sealing of corner holes: Plate material hydraulic mode in which planes for mutual sealing of media around corner hole are arranged on a low plane and a high plane respectively, with height between these planes equal to height of said heat exchange fins; corner hole sealing mode in which integral sealing block is provided on plane of mutual sealing of media around corner hole, with thickness of this block equal to height of said heat exchange fins; and corner hole sealing mode in which corner hole seal ring is provided on plane of mutual sealing of media around each corner hole, with thickness of this ring equal to height of said heat exchange fins.

Most traditional plate-fin heat exchangers without seal strip are used for mutual heat exchange between two media; however, there are also such heat exchangers used for mutual heat exchange among 3 media.

Among traditional plate-fin heat exchangers without seal strip, some adopt heat exchange mode of diagonal flow of media, and some adopt heat exchange mode of side flow (on the same side) of media.

Among traditional plate-fin heat exchangers without seal strip, some adopt heat exchange plates with composite low melting point welding material on their surfaces, while heat exchange fins adopt ordinary foil material (no low melting point welding material on the surfaces).

Among traditional plate-fin heat exchangers without seal strip, some adopt heat exchange plates with no welding material on their surfaces, but heat exchange fins of foil material with composite low melting point welding material on the surface.

Among traditional plate-fin heat exchangers without seal strip, some adopt heat exchange plates of ordinary plate material without surface welding material and heat exchange fins of ordinary foil material without composite low melting point welding material on surfaces, but foil like low melting point welding material between plate and fin.

For plate-fin heat exchangers without seal strip, no matter what sealing mode is adopted for corner holes, mutual heat exchange is for two or three media in one exchanger, diagonal flow or flow at the same side is adopted for heat exchange, or what mode of addition of low melting point welding material is adopted, technical scheme of this invention can be realized by arranging fins transversely in heat exchange zones of heat exchange plates.

As further improvement of this invention, said heat exchange fins can be saw-tooth type fins of various sizes and flat and straight type fins with small holes.

As further improvement of this invention, in the same heat exchanger, in two or more fluid planes corresponding to two or more heat exchange media, each fluid plane can correspond to fins of the same size or different sizes. That is to say, in the same heat exchanger, different fluid planes corresponding to different heat exchange media can adopt fins of the same size or different sizes. Size of heat exchange fins normally refers to fin height, material thickness, and pitch etc. For saw-tooth type fins, this also includes length of notch etc. For flat and straight fins with holes, this also includes hole diameter and spacing etc.

As further improvement of this invention, in the same heat exchanger, in two or more fluid planes corresponding to two or more heat exchange media, each fluid plane can correspond to the same type or different types of heat exchange fins. That is to say, in the same heat exchanger, different fluid planes corresponding to different heat exchange media can adopt fins of the same type, or the same or different sizes, or different types.

As further improvement of this invention, in the same heat exchanger, on each heat exchange plate of at least one heat exchange medium flowing plane, heat exchange fins combination of fins of different sizes or different types are arranged transversely. That is to say, in the same heat exchanger, in different fluid planes corresponding to different heat exchange media, different sizes of saw-tooth type heat exchange fins and flat and straight type heat exchange fins with holes can be arranged transversely on each heat exchange plate in which at least one type of heat exchange medium flows.

As further improvement of this invention, in the same heat exchanger, on each heat exchange plate of at least one heat exchange medium flowing plane, heat exchange fins combination of fins of different sizes or types can be arranged transverse and parallel at the same time. That is to say, in the same heat exchanger, in different fluid planes corresponding to different heat exchange media, on each heat exchange plate in which at least one type of medium flows, different sizes of saw-tooth type heat exchange fins can be arranged transverse while different sizes of flat and straight type heat exchange fins with holes can be arranged parallel, or, different sizes of saw-tooth type heat exchange fins can be arranged parallel while different sizes of flat and straight type of heat exchange fins with holes can be arranged transverse.

As further improvement of this invention, on heat exchange plate, diversion fins are provided between corner hole and various types and sizes of heat exchange fins. Diversion fins can be placed according to heat exchange media flowing requirements.

As further improvement of this invention, heat exchange fins on heat exchange plates in all heat exchange planes adopt transverse arrangement. That is to say, in said heat exchanger, in different fluid planes corresponding to different heat exchange media, various types and sizes of heat exchange fins all adopt transverse arrangement mode.

As further improvement of this invention, on heat exchange plates of all heat exchange planes, among different heat exchange media, heat exchange fins in heat exchange plane in which at least one type of heat exchange medium flows adopt parallel arrangement. That is to say, in said heat exchanger, among different fluid planes corresponding to different heat exchange media, heat exchange fins in some fluid planes adopt transverse arrangement, while heat exchange fins of other fluid planes still adopt traditional parallel arrangement mode.

DESCRIPTION OF DRAWING FIGURES

PREFERRED EMBODIMENTS

The following further describes this invention in combination with attached figures.

Figure 1:
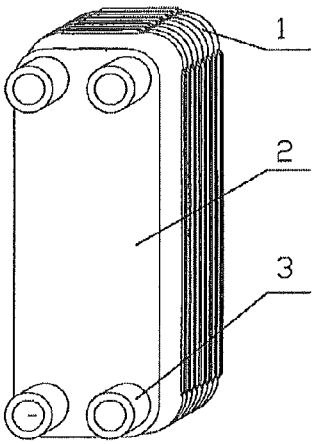
FIG. 1 is schematic of outline of plate-fin heat exchanger without seal strip of this invention.

FIG. 1 shows outline structure of a type of plate-fin heat exchanger without seal strip, comprising heat exchange plate 1 with peripheral cant seal, external retainers 2, and pipe nozzles 3.

Figure 2:
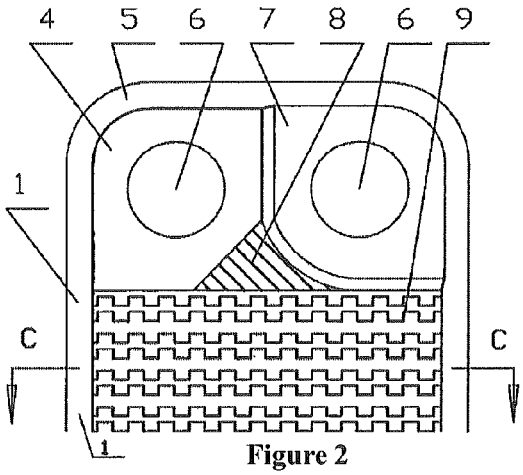
FIG. 2 is schematic of the first type of structure of heat exchange plate of this invention.

FIG. 2 shows a type of structure of heat exchange plate 1 and fins, including corner holes 6, peripheral sealing cant 5, and saw-tooth type heat exchange fins 9 arranged transversely in heat exchange zone on heat exchange plate 1. Said two corner holes 6 are arranged on low plane 4 and high plane 7, with height between low plane 4 and high plane 7 equal to height of heat exchange fins 9. In the area enclosed by low plane 4, high plane 7, and saw-tooth type heat exchange fins 9, diversion fin 8 is provided, with height diversion fin 8 equal to height of fins 9.

Figure 3:
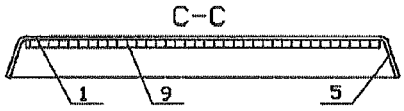
FIG. 3 is schematic of top view of C-C section of FIG. 2.

FIG. 3 is top view of schematic of C-C section of FIG. 2, and shows sealing cant 5 around heat exchange plate 1 and saw-tooth type heat exchange fins 9.

Figure 4:
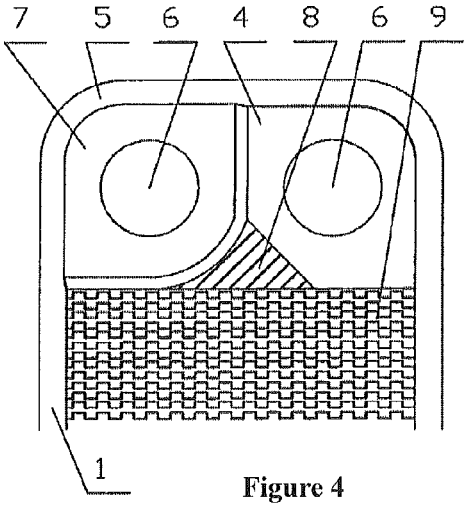
FIG. 4 is schematic of second type of structure of heat exchange plate of this invention.

FIG. 4 shows another structure of heat exchange plate 1 and fins. Difference between FIG. 4 and FIG. 2 is that in heat exchange zone of heat exchange plate 1, size (especially pitch) of saw-tooth type heat exchange fins 10 is different from that of saw-tooth type heat exchange fins 9. Heat exchange plate 1 and fins of different sizes in FIG. 4 and FIG. 2 are provided in the same heat exchanger, indicating two neighboring heat exchange fluid planes for mutual het exchange between two types of heat exchange media. A number of heat exchange plates 1 and various types of fins constitute combination of heat exchange planes.

Figure 5:
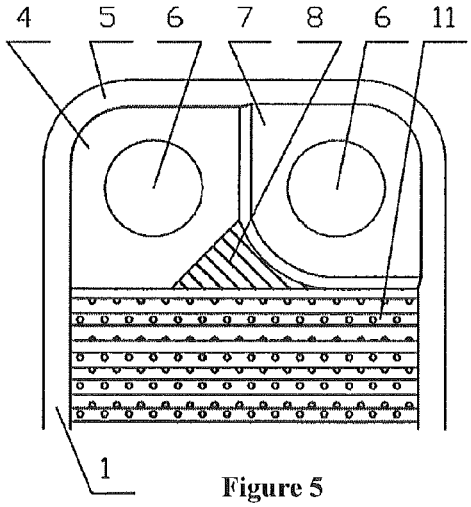
FIG. 5 is schematic of third type of structure of heat exchange plate of this invention.

FIG. 5 shows another structure of heat exchange plate 1 and fins. Different from FIG. 2, in FIG. 5, flat and straight type heat exchange fins 11 are provided transversely in heat exchange zone of heat exchange plate 1.

Figure 6:
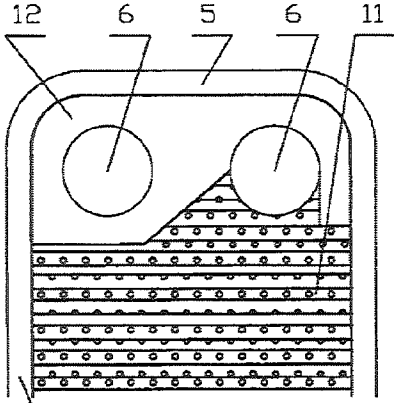
FIG. 6 is schematic of fourth type of structure of heat exchange plate of this invention.

FIG. 6 shows yet another structure of heat exchange plate 1 and corner hole sealing mode. Different from FIG. 5, in FIG. 6, an integral sealing block 12 is provided on the plane of mutual sealing of heat exchange media around two corner holes 6. Thickness of said integral sealing block 12 is equal to height of flat and straight type heat exchange fins with holes 11.

Figure 7:
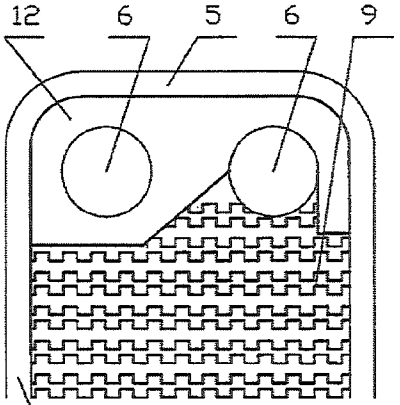
FIG. 7 is schematic of fifth type of structure of heat exchange plate of this invention.

FIG. 7 shows yet another structure of heat exchange plate 1 and fins. In FIG. 7, different from FIG. 6, type of heat exchange fins in heat exchange zone on heat exchange plate 1 is different. FIG. 7 shows a saw-tooth type heat exchange fins 9, and thickness of integral sealing block 12 is equal to height of the saw-tooth type heat exchange fins 9.

Figure 8:
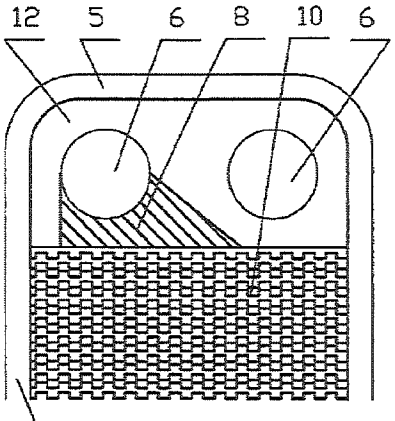
FIG. 8 is schematic of sixth type of structure of heat exchange plate of this invention.

FIG. 8 shows yet another structure of heat exchange plate 1 and fins. Different from FIG. 7, in FIG. 8, there are saw-tooth type heat exchange fins 10 in heat exchange zone on heat exchange plate, one corner hole 6 has diversion fin 8, and thickness of integral sealing block 12 as well as height of diversion fin 8 are equal to height of saw-tooth type heat exchange fins 10.

Figure 9:
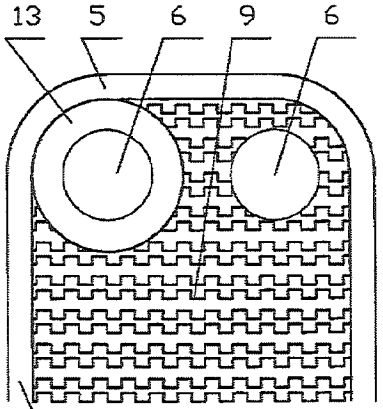
FIG. 9 is schematic of seventh type of structure of heat exchange plate of this invention.

FIG. 9 shows yet another structure of heat exchange plate 1 and corner hole sealing mode. Different from FIG. 7, in FIG. 9, one corner hole 6 is provided with seal ring 13 and thickness of seal ring 13 is equal to height of saw-tooth type heat exchange fins 9.

Figure 10:
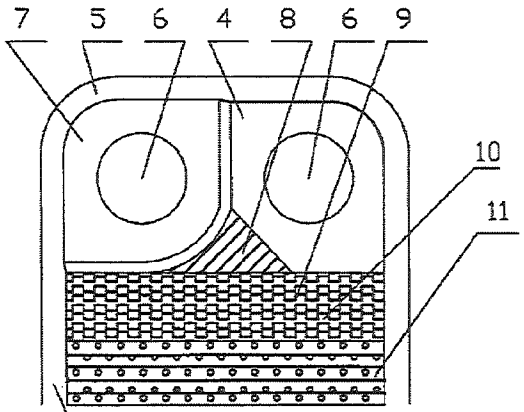
FIG. 10 is schematic of eighth type of structure of heat exchange plate of this invention.

FIG. 10 shows yet another structure of heat exchange plate 1 and fins. Different from FIG. 4, in FIG. 10, in heat exchange zone of heat exchange plate 1, both saw-tooth type heat exchange fins 9 or 10 and flat and straight type heat exchange fins with holes 11 adopt transverse arrangement.

Figure 11:
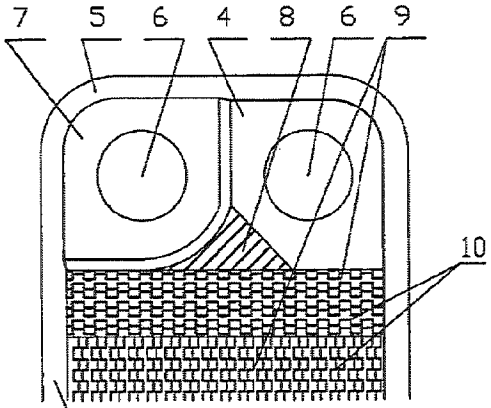
FIG. 11 is schematic of ninth type of structure of heat exchange plate of this invention.

FIG. 11 shows yet another structure of heat exchange plate 1 and fins. Different from FIG. 10, in FIG. 11, in heat exchange zone of heat exchange plate 1, some saw-tooth type heat exchange fins 9 or 10 adopt transverse arrangement, while other saw-tooth type heat exchange fins 9 or 10 adopt parallel arrangement.

Figure 12:
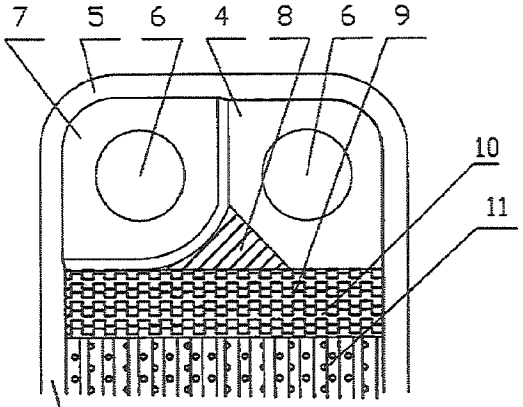
FIG. 12 is schematic of tenth type of structure of heat exchange plate of this invention.

FIG. 12 shows yet another structure of heat exchange plate 1 and fins. Different from FIG. 10, in FIG. 12, in heat exchange zone of heat exchange plate 1, saw-tooth type heat exchange fins 9 or 10 adopt transverse arrangement, while flat and straight type heat exchange fins with holes 11 adopt parallel arrangement.

Figure 13:
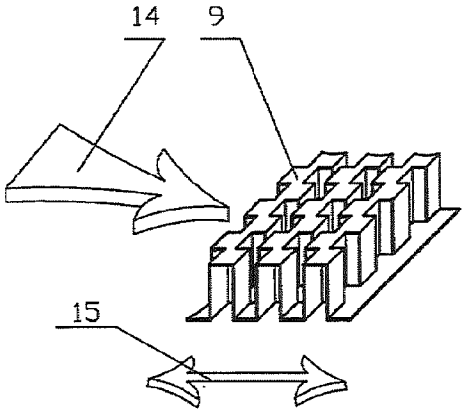
FIG. 13 is schematic of saw-tooth type fins transverse arrangement mode and heat exchange media flow direction.

FIG. 13 shows schematic of heat exchange medium flow direction for transverse arrangement of saw-tooth type heat exchange fins 9 or 10 (as shown in FIG. 12). Fluctuation and extension direction 15 of heat exchange fins 9 or 10 is parallel to overall flow direction 14 of heat exchange medium in heat exchanger.

Figure 14:
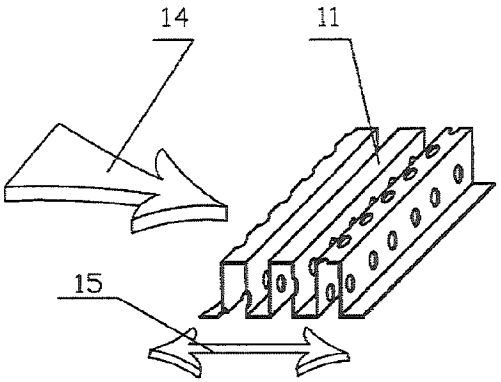
FIG. 14 is schematic of transverse arrangement mode of flat and straight type fins with holes and heat exchange media flow direction.

FIG. 14 shows schematic of heat exchange medium flow direction for transverse arrangement of flat and straight type heat exchange fins with holes 11 (replacing fins shown in FIG. 13). Fluctuation and extension direction 15 of heat exchange fins 11 is parallel to overall flow direction 14 of heat exchange medium in heat exchanger.

The invention claimed is:

1. A type of plate-fin heat exchanger without seal strip, comprising:

a plurality of external retainers;

a plurality of pipe nozzles for receiving a heat exchange medium;

a plurality of heat exchange plates, each of the plurality of heat exchange plates includes a rectangular heat exchange zone defined only by a first set of fins located within the rectangular heat exchange zone, and a second set of fins located within the rectangular heat exchange zone and in contact with the first set of fins, wherein a set of diversion fins are located outside the rectangular heat exchange zone, wherein each of the plurality of heat exchange plates have a peripheral sealing cant; and a first corner hole arranged on a first plane and a second corner hole arranged on a second plane, wherein a height difference between the first plane and the second plane is equal to a height of the first set of fins and the second set of fins;

wherein, the first set of fins are different than the second set of fins, and arranged only in a parallel arrangement within the rectangular heat exchange zone located on the plurality of heat exchange plates of at least one heat exchange media flow plane;

wherein the set of diversion fins are located on an area of each of the plurality of heat exchange plates enclosed by the first plane and the second plane, the area being separate from the first plane and the second plane;

wherein the first set of fins include saw-tooth type heat exchange fins, the first set of saw-tooth type heat exchange fins are defined by a plurality of rows of saw-tooth type fins, each row of the plurality of rows having an equal height and being rectangular in cross-section, and each row having a central longitudinal axis, further wherein each row of the plurality of rows has a plurality of notches that alternate from being on a first side of the central longitudinal axis and a second side of the central longitudinal axis, and define a first face on the first side of the central longitudinal axis and a second face, the first face and the second face being parallel to each other but perpendicular to central longitudinal axis of each row of the plurality of rows to form the saw-tooth pattern;

wherein each row of the plurality of rows are parallel to each other and perpendicular to a sidewall of a heat exchange plate of the plurality of heat exchange plates, the sidewall being parallel to a longitudinal axis of the heat exchange plate;

wherein the second set of fins are flat and straight fins, having a plurality of holes therethrough, the second set of flat and straight fins defined by a plurality of continuous rows, each row of the plurality of continuous rows are parallel to each other and perpendicular to the sidewall of the heat exchange plate of the plurality of heat exchange plates;

wherein the heat exchange medium being received through at least one inlet proximate at least one of the plurality of nozzles flows from the at least one inlet through the set of diversion fins located outside the rectangular heat exchange zone and through the rectangular heat exchange zone, the heat exchange medium flowing through the rectangular heat exchange zone being blocked and disturbed by the first set of fins and the second set of fins so that the heat exchange medium is forced to flow transversely in a short distance passing the plurality of notches and the plurality of holes, until exiting at least one outlet located proximate at least one of the plurality of nozzles.

2. The plate-fin heat exchanger without seal strip of claim 1, wherein the second set of fins include flat and straight type heat exchange fins with holes.

3. A type of plate-fin heat exchanger without seal strip, comprising:

a plurality of external retainers;

a plurality of pipe nozzles for receiving a heat exchange medium;

a plurality of heat exchange plates, each of the plurality of heat exchange plates includes a rectangular heat exchange zone defined only by a first set of fins located within the rectangular heat exchange zone, and a second set of fins located within the rectangular heat exchange zone and in contact with the first set of fins, wherein a set of diversion fins are located outside the rectangular heat exchange zone, wherein and each of the plurality of heat exchange plates have a peripheral sealing cant; and a first corner hole arranged on a first plane and a second corner hole arranged on a second plane, wherein a height difference between the first plane and the second plane is equal to a height of the first set of fins and the second set of fins;

wherein, the second set of fins are different than the first set of fins, and arranged only in a transverse arrangement within the rectangular heat exchange zone located on the plurality of heat exchange plates of at least one heat exchange media flow plane;

wherein the set of diversion fins are located on an area of each of the plurality of heat exchange plates enclosed by the first plane and the second plane, the area being separate from the first plane and the second plane;

wherein the first set of fins include saw-tooth type heat exchange fins, the first set of saw-tooth type heat exchange fins are defined by a plurality of rows of saw-tooth type fins, each row of the plurality of rows having an equal height and being rectangular in cross-section, and each row having a central longitudinal axis, further wherein each row of the plurality of rows has a plurality of notches that alternate from being on a first side of the central longitudinal axis and a second side of the central longitudinal axis, and define a first face on the first side of the central longitudinal axis and a second face, the first face and the second face being parallel to each other but perpendicular to central longitudinal axis of each row of the plurality of rows to form the saw-tooth pattern;

wherein each row of the plurality of rows are parallel to each other and parallel to a side wall of a heat exchange plate of the plurality of heat exchange plates, the sidewall being parallel to a longitudinal axis of the heat exchange plate;

wherein the second set of fins are flat and straight fins, having a plurality of holes therethrough, the second set of flat and straight fins defined by a plurality of continuous rows, each row of the plurality of continuous rows are parallel to each other and perpendicular to the sidewall of the heat exchange plate of the plurality of heat exchange plates;

wherein the heat exchange medium being received through at least one inlet proximate at least one of the plurality of nozzles flows from the at least one inlet through the set of diversion fins located outside the rectangular heat exchange zone and through the rectangular heat exchange zone, the heat exchange medium flowing through the rectangular heat exchange zone being blocked and disturbed by the first set of fins and the second set of fins so that the heat exchange medium is forced to flow transversely in a short distance passing the plurality of notches and the plurality of holes, until exiting at least one outlet located proximate at least one of the plurality of nozzles.

4. The type of plate-fin heat exchanger without seal strip of claim 1, wherein the first set of fins is transverse to the flow of the heat exchange medium.

5. The type of plate-fin heat exchanger without seal strip of claim 1, wherein the heat exchange medium flows in a continuous "S" shaoe in transverse fins in each of the plurality heat exchange planes.

6. The type of plate-fin heat exchanger without seal strip of claim 3, wherein the first set of fins is transverse to the flow of the heat exchange medium.

7. The type of plate-fin heat exchanger without seal strip of claim 3, wherein the heat exchange medium flows in a continuous "S" shaoe in transverse fins in each of the plurality heat exchange planes.

* * * * *